United States Patent [19]

Kuroda et al.

[11] Patent Number: 4,898,001

[45] Date of Patent: Feb. 6, 1990

[54] GAS TURBINE COMBUSTOR

[75] Inventors: Michio Kuroda; Isao Sato; Yoji Ishibashi; Yoshihiro Uchiyama; Takashi Ohmori; Shigeyuki Akatsu, all of Hitachi; Fumio Kato, Toukai; Yorihide Segawa; Katsuo Wada; Nobuyuki Iizuka, both of Hitachi, all of Japan

[73] Assignee: Hitachi, Ltd., Tokyo, Japan

[21] Appl. No.: 144,646

[22] Filed: Jan. 11, 1988

Related U.S. Application Data

[63] Continuation of Ser. No. 752,680, Jul. 8, 1985, abandoned.

[30] Foreign Application Priority Data

Oct. 7, 1984 [JP] Japan ..... 59-143852
Oct. 7, 1984 [JP] Japan ..... 59-143851

[51] Int. Cl.[4] ..... F23R 3/34

[52] U.S. Cl. ..... 60/733; 60/737; 60/748

[58] Field of Search ..... 60/732, 733, 746, 748, 60/754, 737–739

[56] References Cited

U.S. PATENT DOCUMENTS

| | | | |
|---|---|---|---|
| 2,583,416 | 1/1952 | Clarke et al. | 60/738 |
| 2,676,460 | 4/1954 | Brown . | |
| 2,999,359 | 9/1961 | Murray | 60/733 |
| 4,151,713 | 5/1979 | Faitani et al. . | |
| 4,292,801 | 10/1981 | Wilkes et al. | 60/733 |
| 4,344,280 | 8/1982 | Minakawa et al. . | |
| 4,598,553 | 7/1986 | Saito et al. | 60/733 |

FOREIGN PATENT DOCUMENTS

| | | | |
|---|---|---|---|
| 2455909 | 6/1975 | Fed. Rep. of Germany | 60/733 |
| 3217674 | 12/1982 | Fed. Rep. of Germany . | |
| 240833 | 11/1985 | Japan | 60/733 |
| 650608 | 2/1951 | United Kingdom | 60/738 |
| 894054 | 4/1962 | United Kingdom | 60/746 |
| 2097113 | 10/1982 | United Kingdom . | |
| 2146425 | 4/1985 | United Kingdom | 60/733 |

*Primary Examiner*—Louis J. Casaregola
*Assistant Examiner*—Timothy S. Thorpe
*Attorney, Agent, or Firm*—Antonelli, Terry & Wands

[57] ABSTRACT

A gas turbine combustor for reducing a production of NOx. The combustor includes a head combustion chamber and a rear combustion chamber which is larger in diameter than the head combustion chamber. The head combustion chamber is provided with an axially extending hollow frustoconical tubular member to form an annular combustion space therein, air holes for axially jetting air into the annular combustion chamber, air holes formed on a peripheral wall for injecting air and a plurality of fuel nozzles projected into the annular combustion space for injecting fuel into vortex formed by the air jet and the injected air flow whereby the flame is stabilized and lean combustion can be effected. The rear combustion chamber has a fuel and air supply means on the upstream side which includes air inlets formed by whirling vanes and fuel nozzles disposed in the air inlets so that fuel and air are mixed well. The fuel and air mixture is jetted substantially axially while whirling it so that formation of hot spots is avoided and the NOx formation is extremely limited.

25 Claims, 14 Drawing Sheets

GAS TURBINE COMBUSTOR

This application is a divisional of application Ser. No. 752,680, filed July 8, 1985, now abandoned.

BACKGROUND OF THE INVENTION

The present invention relates to a gas turbine combustor and, more particularly to a gas turbine combustor, of a two-stage combustion system, which burns a gaseous fuel such as natural gas (LNG) producing relatively small amount of very NOx.

A method of reducing NOx in the gas turbine combustor is roughly divided into a wet-type method which uses water or water vapor, and a dry-type method which is based upon the improved combustion performance. In the former method a medium such as water is employed, with the resulting water vapor decreasing turbine efficiency. The dry-type method of reducing Nox is superior to the wet-type method, however, since dry-type method is to sustain combustion with a fall lean mixture at a low uniform temperature, carbon monoxide is generated in large amounts though only small amounts of NOx are generated.

During combustion, in general, formation of NOx is dominated by a combustion gas of a local high-temperature portion (higher than 1800° C.) in the combustion region. NOx is formed mainly by two conditions, namely the oxidation of nitrogen contained in the uncombusted exhaust and the oxidiation of nitrogen contained in the combustion air. These two conditions will hereafter be called the thermal NOx and the fuel NOx. The thermal NOx is largely dependent upon the oxygen concentration and the reaction time, which, in turn, are affected considerably by the gas temperature. Therefore, combustion can be sustained while effectively reducing the formation of NOx if a uniform temperature lower than 1500° C. is maintained without permitting the high-temperature regions to occur in the combustion.

To reduce the formation of NOx in the gas turbine, the lean diffusion combustion method has heretofore been most advantageously employed, since a gas turbine combustor permits a relatively large air flow rate with respect to the fuel flow rate, and it makes it possible to control the distribution of air in the combustion chamber to some extent. The chief concern is that combustion is performed over a low uniform temperature range, by reducing combustion temperature, facilitating mixing, and reducing time during which NOx is formed.

A conventional technique for realizing the above-mentioned combustion has been disclosed, for example in Japanese Patent Publicaiton No. 20122/1980, in which a plurality of fuel nozzles are annularly arranged in an annular combustion chamber, and the air and water vapor are introduced from the downstream side of an inner cylinder installed coaxially of the combustion chamber. The combustor employs a combustion method in which the fuel is supplied into the combustion chamber and dispersed over the cross section thereof, so as to make the combustion temperature uniform and to decrease gas temperature downstream of the combustion chamber. Further, flame stabilizers of the type disclosed, for example, in Japanese Patent Laid Open Application No. 202431/1982 consist of swirlers installed around the fuel nozzles for stabillizer the combustion flame in the region of whirling stream formed by whirling air. During combustion, however, extremely hot gases are present in the region of the whirling stream in order to maintain and stabilize the flame near the fuel nozzles, thereby making it difficult to reduce NOx. In the flame stabilizer having air whirling vanes, a relatively high air flow velocity ($V > 30$ m/s) is necessary to function within its effective range where the Reynolds number Re is greater than $10^5$. Further, as the flame is reduced in length, combustion is likely to take place most rapidly near the fuel nozzles. Moreover, an intense flame stabilization at a localized high-temperature portion in the region of whirling flow which is 1 to 2 times wider than the diameter of the flame stabilizer, induces the formation of NOx. Therefore, even if a plurality of fuel nozzles having a conventional flame stabilizer are provided, they are unlikely to greatly reduce the formation of NOx. Particularly for combustion in which NOx is formed in small amounts, it is essential to provide a flame stabilizing mechanism that effectively reduces the rate of NOx formation. The mode of combustion is greatly affected by the flame-stabilizing characteristics.

A combustor employing the two-stage combustion system has been disclosed, for example, in Japanese Patent Laid-Open No. 41524/1982. In this combustor, a pre-mixture gas of fuel and air is introduced into a first-stage (head) combustion chamber where combustion is effected by a single nozzle. Then, fuel and air are simultaneously supplied via air holes into a second-stage (rear) combustion chamber on the downstream side, in order to sustain low-temperature combustion with a lean mixture so that NOx is formed in reduced amounts.

However, according to the method in which a combustion flame is formed in a distributed manner by a single nozzle in the head combustion chamber, and the fuel in the second stage is introduced downstream, it is difficult to limit the formation of NOx. That is, formation of NOx can be suppressed in the combustion of the second stage by introducing fuel at the second stage. In the combustion taking place in a distributed manner in the first stage, however, hot spots are formed over wide areas, making it difficult to suppress the formation of NOx. Furthermore, the single nozzle which exists on the axis of the combustion chamber makes it difficult to properly mix the fuel with the air stream that flows from the side walls of the combustion chamber, giving rise to the formation of hot spots. Thus, with the conventional combustor having a single fuel injection nozzle at the head of the combustion chamber, it is difficult to greatly limit the formation of NOx. Even with the two-stage combustor as described above, it is essential to limit the formation of NOx in the first stage and in the second stage, in order to strictly limit the total formation of NOx. In the conventional technique having a single fuel nozzle on the axis of the head portion, however, it is not possible to strictly limit the formation of NOx.

Further, even if the above-mentioned multi-fuel nozzles with the conventional flame stabilizers are employed for first stage combustion in place of the above-mentioned single fuel nozzle, the formation of NOx is not greatly reduced in amounts. The flame generated by the multi-fuel nozzles is too firmly stabilized to prevent the formation of local high temperature portions. NOx formation takes place near the nozzles, and the produced NOx is reduced in the second stage combustion.

SUMMARY OF THE INVENTION

An object of the present invention is to provide a gas turbine combustor which effectively stabilizes the flame in a combustion chamber at the head portion of the combustor, and which facilitates a type of combustion which produces NOx in relatively small amounts.

Another object of the present invention is to provide a gas turbine combustor of a two-stage combustion system which employs a fuel diffusion method that does not form local high-temperature combustion portions in the head portion, thereby limiting the formation of NOx, and in which the mixing space is small so as to facilitate mixing fuel with the air, and which establishes low-temperature lean combustion in the head portion and in the rear portion in order to limit the formation of NOx.

The present invention supplies the fuel in a distributed manner in order to eliminate the presence of high-temperature spots, the so-called hot spots in the combustion portion that govern the formation of NOx. That is, a gas turbine combustor according to the present invention is provided with a plurality of fuel nozzles arranged in annularly dispersed manner for each of first and second combustion stages in order to disperse fuel and promote the mixing of fuel with air, a hollow frustoconical tubular member in the head combustion chamber thereby providing an annular combustion space therein which defines a small mixing space to eliminate hot spots that may take place in the central portion in the head combustion chamber, and to properly mix the fuel and the air in the head combustion chamber. The fuel nozzles for the first combustion stage are arranged so as to inject fuel into eddy or vortex flow formed by an air jet from the end wall of the head combustion chamber and air flow from the peripheral wall of the head combustion chamber, whereby the flame resulting from combustion of the fuel is stably maintained under relatively lean conditions and lean-fuel low-temperature combustion is effected. In the rear combustion chamber for the second combustion stage, furthermore, the tip holes of the fuel nozzles are located in the air stream to promote the mixing of the air with the fuel so that and the fuel and air mixture flows in parallel to the axis of the chamber, thereby eliminating the occurence of hot spots and greatly reducing formation of NOx.

BRIEF DESCRIPTION OF THE INVENTION

Figure 6:
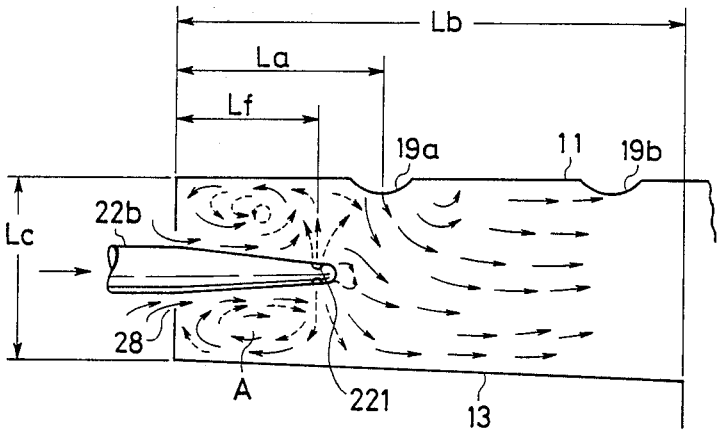
Figure 7:
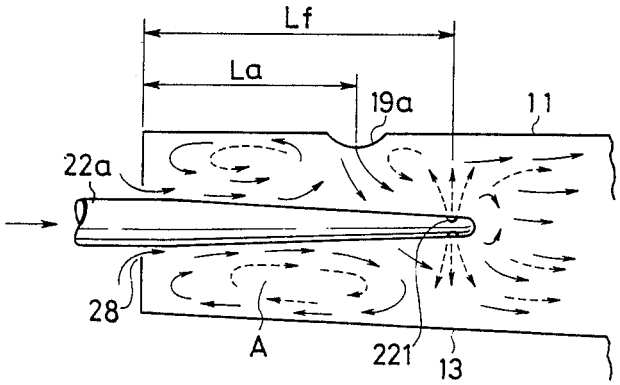
Figure 8:
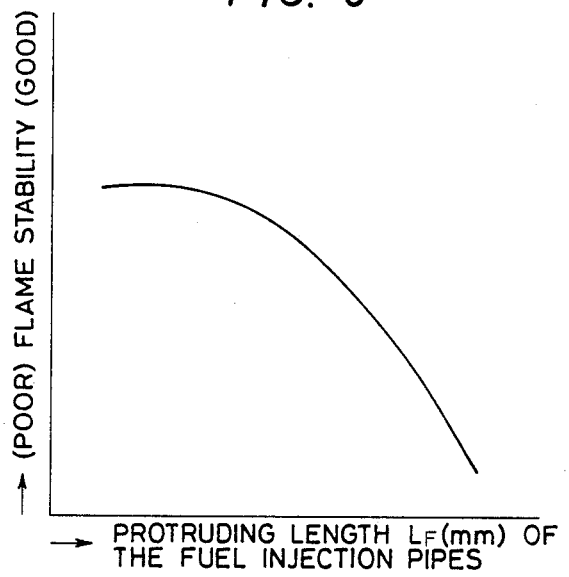
Figure 9:
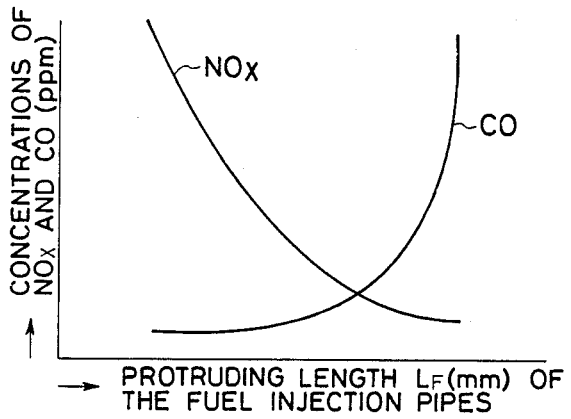
Figure 10:
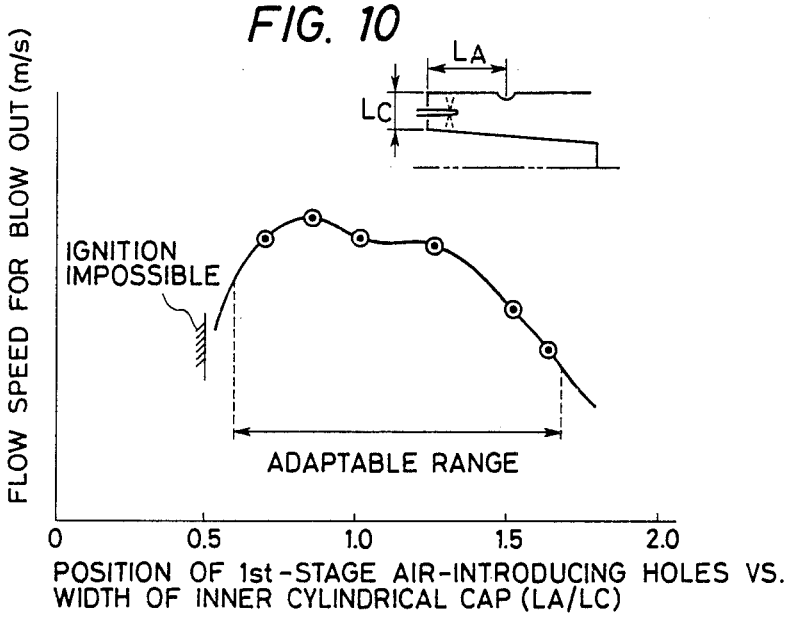

FIGS. 6 and 7 each are schematic views illustrating a flow pattern of the air and fuel in the head portion of the combustion chamber;

FIG. 8 is a graphical illustration showing flame stability depending upon the protruding length of the fuel nozzle;

FIG. 9 is graphical illustration showing a relationship between NOx and CO concentrations and the fuel nozzle protruding length;

FIG. 10 is a graphical illustration showing a relationship between the flow speed for blow out and LA/LC.

Figure 11:
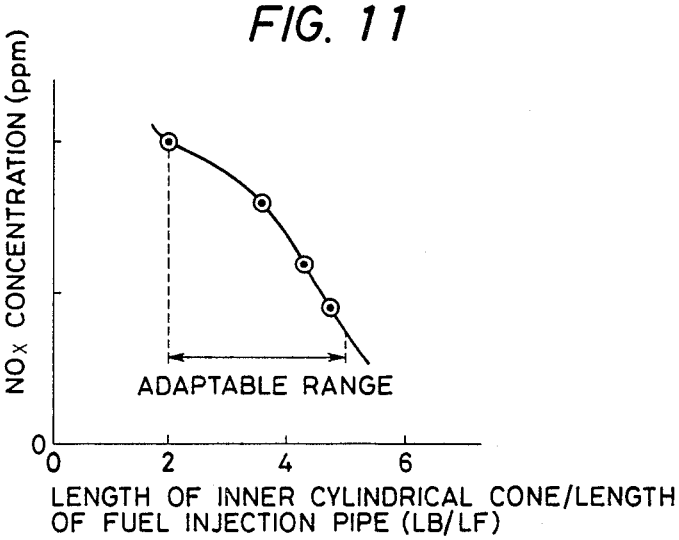
Figure 12:
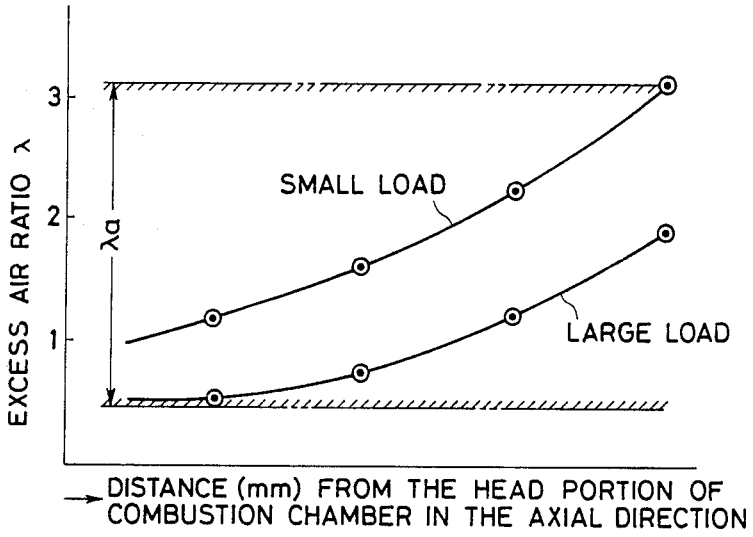
Figure 13:
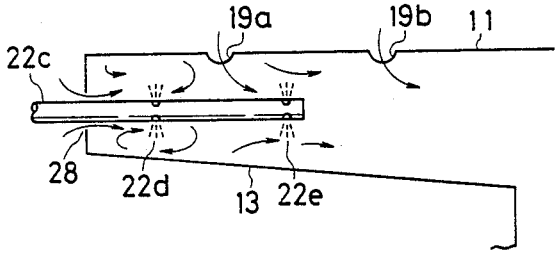
Figure 14A:
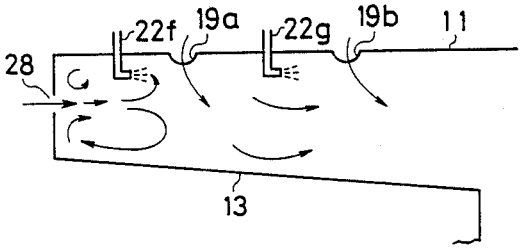
Figure 14B:
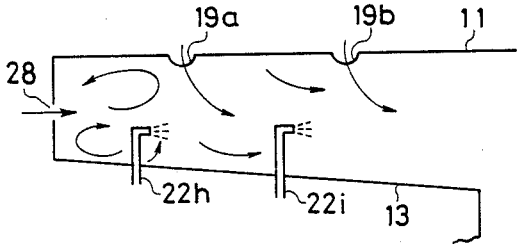
Figure 15:
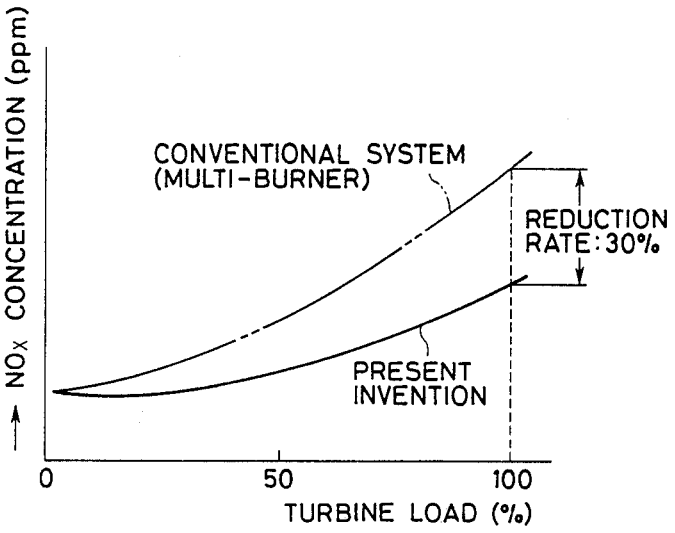
Figure 16:
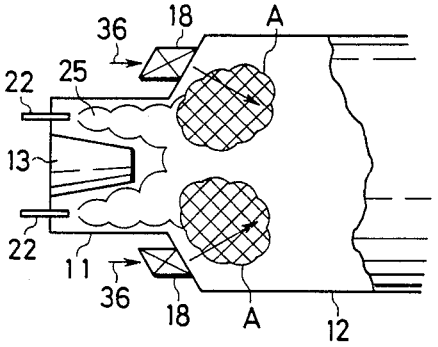
Figure 17:
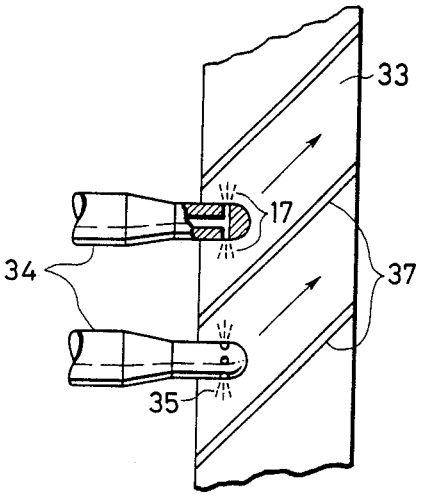
Figure 18:
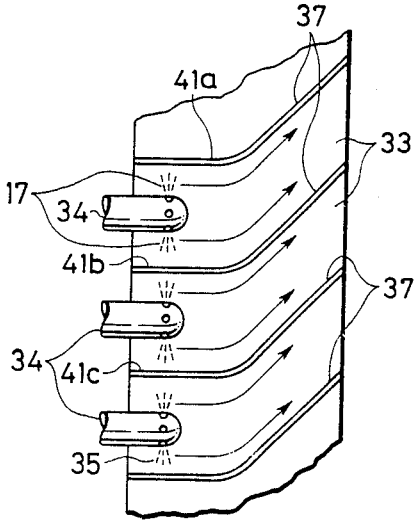
Figure 19:
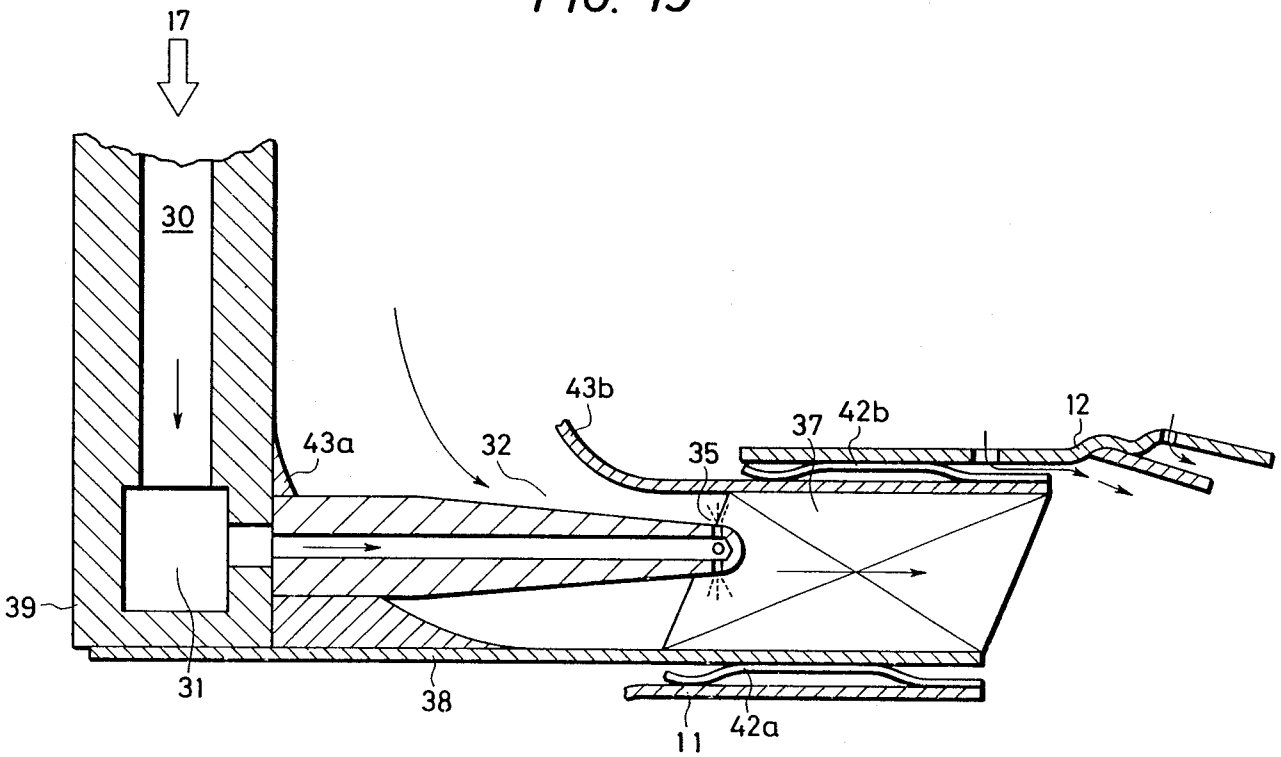
Figure 20:
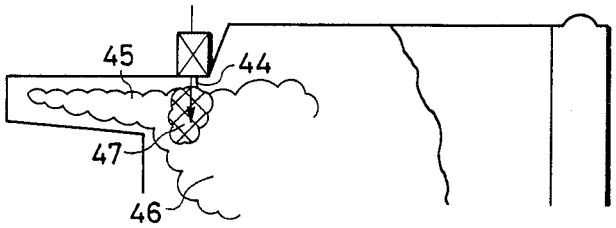
Figure 21:
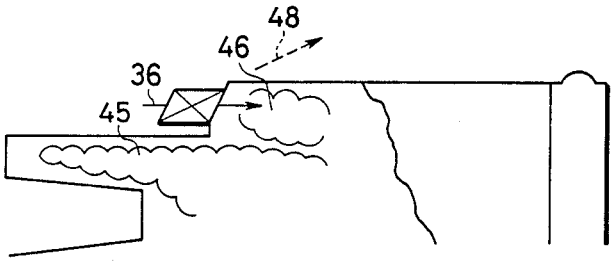
Figure 22:
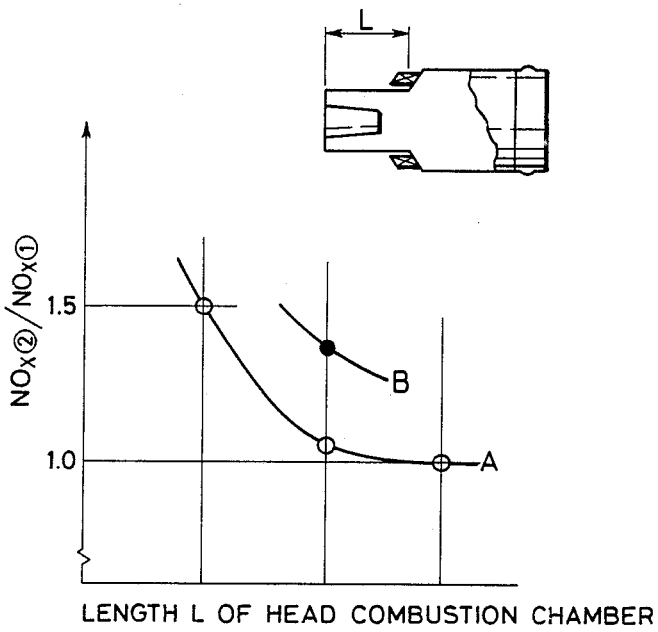
Figure 23:
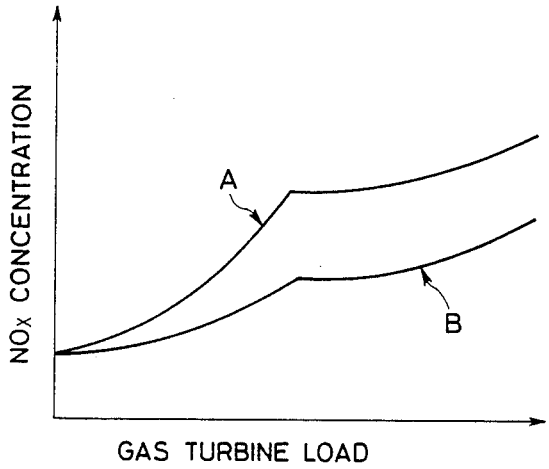
Figure 24:
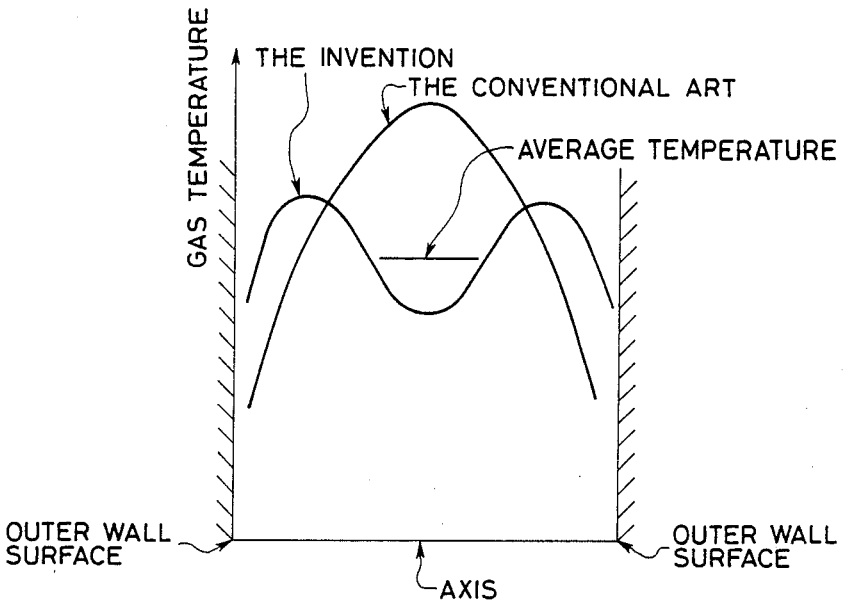

FIG. 11 is a graphical illustration showing a relationship between the NOx concentration and LB/LF;

FIG. 12 is a graphical illustration showing an excess air ratio at various positions in the head combustor;

FIG. 13 is a schematic partial view of a head combustion chamber according to another embodiment of the present invention;

FIGS. 14*a* and 14*b* each are a modification of the head combustion chamber shown in FIG. 13;

FIG. 15 is a graphical illustration showing relationships of NOx concentration to turbine load;

FIG. 16 is a schematic view for explaining the formation of a combustion flame;

FIG. 17 is a schematic detail view of the fuel supply portion;

FIG. 18 is a schematic detail view of the fuel supply portion according to another embodiment of the invention;

FIG. 19 is a cross-sectional view showing the fuel supply portion of the second stage according to another of the invention;

FIGS. 20 and 21 are diagrams showing the direction of supplying fuel in the second stage and interfering condition of the flames;

FIG. 22 is a schematic view of characteristics showing a relationship between the length of the head combustion chamber and the effect for reducing NOx;

FIG. 23 is a graphical illustration of characteristics showing a relationship between the gas turbine load and the NOx conentration; and FIG. 24 is a graphical illustration of characteristics showing temperature distribution of flames.

DETAILED DESCRIPTION

An embodiment of a gas turbine combustor according to the present invention is described hereinafter referring to the drawings.

Figure 1:
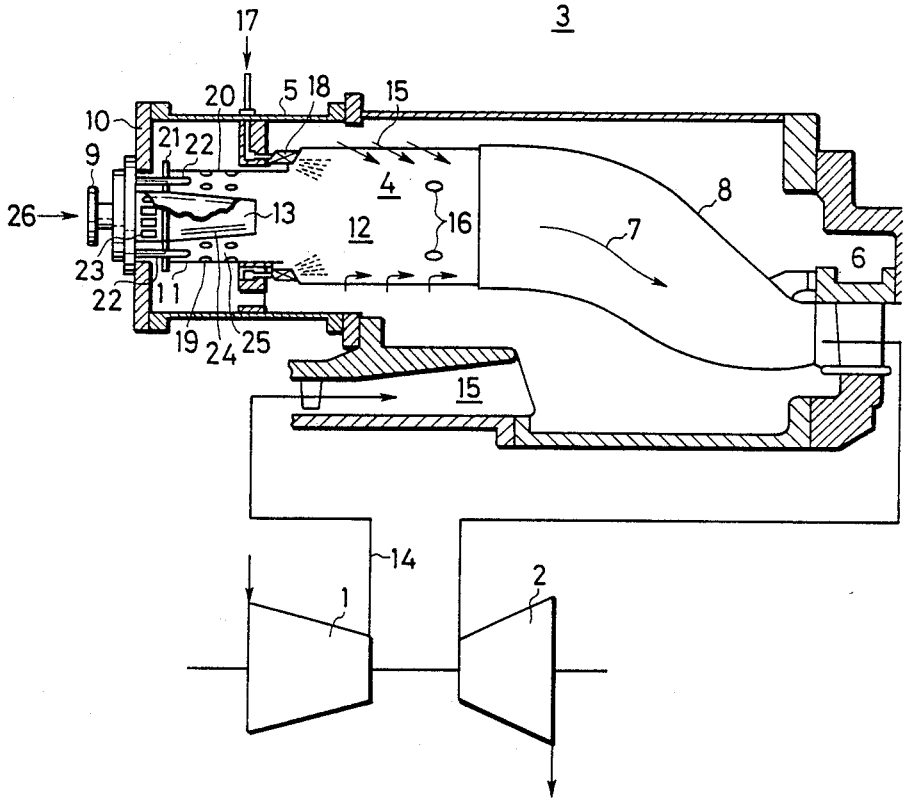
FIG. 1 is a sectional view of a gas turbine combustor according to an embodiment of the present invention.
Figure 2:
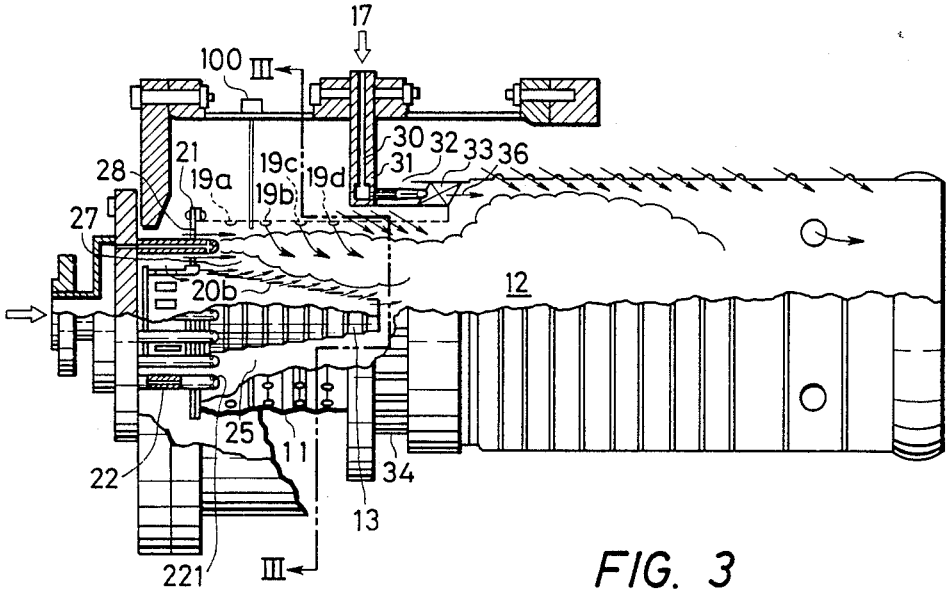
FIG. 2 is a partial enlarged sectional view of a detail of the combustor of FIG. 1.

Referring now to the drawings wherein like reference numerals are used throughout the various views to designate like parts and, more particularly, to FIGS. 1 and 2, according to these figures, gas turbine includes compressor 1, a turbine 2, and a combustor generally designated by the reference numeral 3 which is made of an inner casing including an inner a cylinder generally designated by the reference numeral 4, an outer casing including a cylinder 5 and a tail cylinder 8 for introducing a combustion gas 7 to the stator blades 6 of the turbine. An end cover 10 is mounted on a side end of the outer cylinder 5 to accommodate a fuel nozzle body 9 of first stage. The combustor is 3 further includes an ignition plug 100 and a flame detector that senses the flame (not shown). The inner cylinder 4 is divided into a head combustion chamber 11 and a rear combustion chamber 12 having a diameter larger than that of the head combustion chamber 11. A hollow frustoconical tube or cone 13 is inserted concentrically in the head combustion chamber 11, with the cone 13 being narrowed from the upstream side toward the downstream side thereby forming an annular space 25 which gradually increases in sectional area from the upstream side to the downstream side, and having front end with fine air openings.

An air stream 14 compressed by the compressor 1 passes through a diffuser 15, is routed around the tail cylinder 8, and is introduced into the combustion chambers via louvers 151 and lean air holes 16 formed in the inner cylinder 4, via air holes 18 for burning fuel 17 of a second stage, via air holes 19 for combustion formed in the head combustion chamber 11, and via louvers 20. Fuel nozzles 22 of the first stage, annularly provided on the nozzle body 9, penetrate through the end wall (liner cap) 21 of the head combustion chamber 11, and have a plurality of fuel injection holes 221 to inject fuel into the head combustion chamber 11.

The cone 13 has inlet holes 23 for introducing the air, as well as a plurality of cooling-air holes 24 that are annularly arranged in each of a plurality of rows so that the air will flow along the surface of the cone 13.

Figure 3:
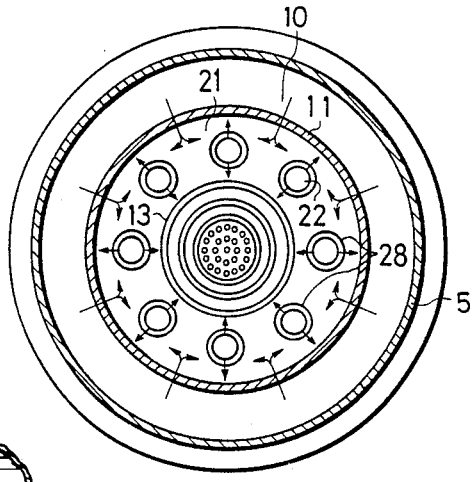
FIG. 3 is a sectional view taken along a line III—III in FIG. 2.

As shown in FIG. 3, the plurality of fuel nozzles 22 are arranged annularly and penetrate through the end wall 21, with annular spaces for air passages formed between the end wall holes 28 and the nozzle surfaces. The fuel injection holes 221 of the nozzles 22 are located upstream of head combustion chamber 11 and open nearly at right-angles to the axis of the inner cylinder 4. The fuel 27 jetted therefrom is mixed with the air introduced through the air holes 19*a*, 19*b*, 19*c* and 19*d* formed in the wall of the head combustion chamber 11, so that combustion is sustained. Unlike a single injecton nozzle conventionally employed, the fuel nozzles 22 are located close to the side wall of the head combustion chamber 11. Therefore, the fuel is quickly mixed with the air introduced through the air holes 19*a*, 19*b*, 19*c*, 19*d*, and with the air stream from the air holes 28, making it possible to increase the cooling effect of the air at the initial stage of combustion. Therefore, development of hot spots can be suppressed and the formation of NOx can be reduced. Thus, a plurality of fuel injection holes 221 are provided at positions close to the side wall of the head combustion chamber 11, in order to promote the above-mentioned mixing effects, as well as to disperse the flame or to establish a so-called divisional combustion. Owing to these synergistic effects, formation of NOx can be reduced greatly.

The provision of the cone 13 further limits the formation of NOx, so that the cooling effect and the mixing effect are not lost. The air through the air holes 19*a*, 19*b*, 19*c*, 19*d* formed in the side wall of the head combustion chamber 11 is not allowed to reach the central portion because there is the cone 13 there. Furtheremore, the formation of NOx can be greatly limited since the flame is effectively cooled by the cone 13 and is cooled from the inner side by the cooling air 20*b* that is ejected from a plurality of fine holes 24 formed annularly in the surface of the cone 13.

The fuel nozzles 22 facilitate mixing the fuel with the air introduced upstream from the fuel injection holes 221 depending upon the length by which they protrude into the combustor 3, and are a crucial factor in limiting the formation of NOx. Good mixing is obtained if the fuel injection holes 221 are near the air holes 19*a*, and formation of NOx is strictly limited.

The fuel injection holes 221 of the fuel nozzles 22 are positoned near the air holes 19*a* annularly arranged and form a first air hole row.

Figure 4:
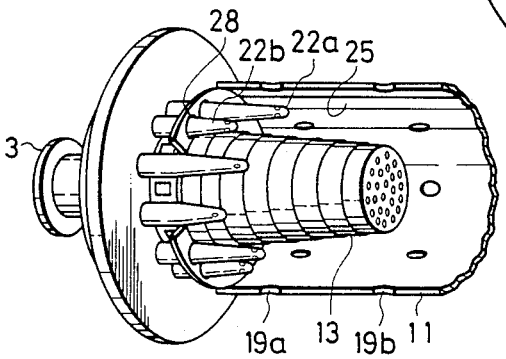
FIG. 4 is a perspective view of a head combustion chamber according to another embodiment of the present invention.

As shown in FIG. 4, furthermore, long fuel nozzles 22*a* and short fuel nozzles 22*b* are arranged alternatingly to change the positions for injecting the fuel into the combustion chamber 3, for instance. In such a case, when the position of the group of air holes 19*a* is regarded as a reference position, the fuel nozzle 22*a* inject the fuel downstream from the group of air holes 19*a*, and the fuel nozzle 22*b* inject the fuel upstream therefrom.

Figure 5:
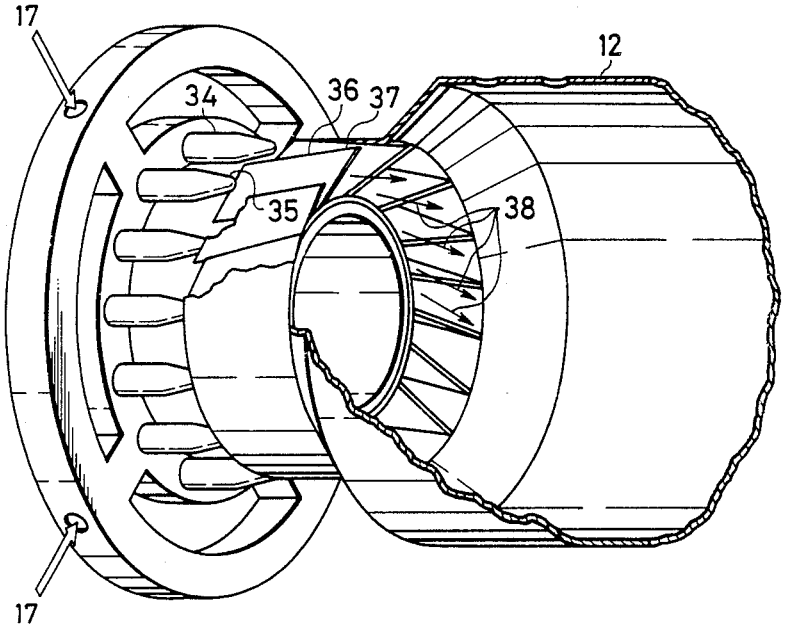
FIG. 5 is a partially sectional perspective view of the second stage fuel supply portion of the gas turbine combustor shown in FIG. 1.

Air and fuel supply means for the second stage, as shown in FIG. 5, is provided on the inner 4 on the upstream side end of the rear combustor chamber 12 for second combustion stage. The air and fuel supply means consists of air inlets formed by a plurality of whirling vanes 37, and fuel nozzles, 34 each disposed between the vanes 37. The fuel nozzles 34 are mounted on a nozzle flange in which passages for fuel 17 are formed for supplying fuel into each fuel nozzles 34. The nozzle 34 has fuel injection holes 35 at a tip thereof.

FIGS. 6 and 7 illustrate flow patterns of the air and fuel near the head portion of the combustion chamber 11, wherein solid lines indicate the flow of air, and the chain lines indicate the flow condition of fuel.

The air flowing through gaps formed between the fuel nozzle 22 (22*a* or 22*b*) and the air holes 28 formed in the end wall 21 flows along the fuel nozzle 22, whereby a reverse flow takes place due to a pressure differential between the air jet and the air in space, and a relatively weak vortex flow is established around the fuel nozzles 22 on the upstream side thereof. The vortex flow includes upward flows and downward flows and is further reinforced by the reverse flow components produced by the air jet from the outer wall of the inner cylinder 4. Under the above-mentioned air-flow condition, when the fuel is injected via fuel nozzles 22*b*, 22*a* into the upstream portion ($La > Lf$) with respect to the air holes 19*a* of the first stage as shown in FIG. 6, the fuel is taken in large amounts by the vortex region A and the fuel concentration increases. When the fuel is injected at a position behind the air jet ($La < Lf$) that flows via the air holes 19*a* formed in the outer wall of the inner cylinder 4 as shown in FIG. 7, the fuel flows in very small amounts into the vortex region A that is formed upstream from the fuel nozzles. It is evident that the difference in the fuel concentration in the vortex flow region seriously affects the flame-stabilizing performance and combustion characteristics.

FIGS. 8 and 9 illustrate experimental results related to flame stability and combustion characteristics determined by the length Lf of fuel nozzles 22 from the end wall 21 to the fuel injection hole 221. The stability of flame increases with the decrease in the length Lf of the fuel nozzles however, Nox, is formed in increasing amounts. If the fuel nozzles 22*a*, 22*b* are lengthened, Nox is formed in reduced amounts, but uncombusted gases such as carbon monoxide and the like increase and the flame stability decreases.

With regard to the construction of the combustor, furthermore, length of the cone 13 constituting the combustion chamber and the position of the air holes serve as other factors that greatly affect the combustion characteristics.

The plurality of air holes 28 are formed in the end wall 21 at the head portion of the combustion chamber to surround the fuel nozzle 22. Or, the air may be introduced from positions inside or outside of the combustion chamber to sufficiently accomplish the object, provided it does not interrupt the vortex flow region but rather reinforces it. In the construction of this embodiment, in particular, the position of air holes of the first stage serves as a factor that controls the dimensions and intensity of the vortex flow region, and greatly affects the stability of flame.

FIG. 10 shows flame blow-out characteristics when the position of injecting fuel is maintained constant in relation to a ratio of a distance La between the side wall 21 and the first air hole row, to the width Lc of the annular combustion chamber at the end wall 21. When the adaptable range of ratio La/Le is smaller than 0.6, the vortex flow region that contributes to stabilizing the flame decreases, and the combustion becomes less stable due to the lean mixture that results from the surrounding flow of air and due to the decrease in the combustion temperature. When the ratio La/Lc is smaller than 0.5, it is difficult to ignite the mixture. When the ratio La/Lc is greater than 1.7, the vortex flow region increases noticeably. However, dead space is formed, and the temperature rises in this dead space, thereby making it difficult to reduce the formation of NOx. In the flame stabilizing mechanism of this embodiment, in particular, the flame is generated near the fuel injection holes of the fuel injection nozzles, and combustion is sustained by the combustion product (high-temperature gas) that flows from downstream to upstream due to the surrounding air flow, and the flame is thereby stabilized.

Next, described below in detail are the cone 13 installed at the central portion of the inner cylinder 4 and the protruding length Lf of the fuel nozzles 22. When the cone 13 is used, a high-temperature combustion portion is less likely to form at the center of the combustion chamber than when the cone 13 is not used. Since an annular combustion space or chamber 25 is formed, this facilitates both dispersed fuel injection and mixed fuel with air introduced from the wall surface of the inner cylinder 4. Relatively lean combustion is thereby sustained so that a high-temperature portion does not develop. Therefore, less intense combustion can be accomplished which is less likely to form Nox.

FIG. 11 shows the relationship between the concentration of NOx and the ratio of the length Lb of the cone to the protruding length Lf of the fuel nozzles 22. As the length Lb of the cone 13 increases, Nox is formed in reduced amounts. However, if the cone 13 is too long, the amount of air introduced decreases at the head combustion chamber 11. The cooling function decreases on the wall of the head combustion chamber 11 and on the wall of the cone 13, and the temperature of the metal rises thereby reducing reliability. If the length Lb of the cone 13 is reduced, fuel and air are not well mixed. The air is introduced in large amounts due to the pressure differential between the inside and the outside of the inner cylinder which pressure difference is caused by the enlargement of the annular combustion chamber into a cylindriacl combustion chamber during the combustion. Therefore, combustion is intense near the end of the cone 13, and NOx is formed in excessive amounts. Accordingly, the adaptable range for the cone 13 is Lb/Lf=2.0 to 5.0.

FIG. 12 specifically shows the condition of air flow near the head portion of combustion chamber. The air is introduced in such amounts so as to fall within combustible ranges at all times when the gas turbine is in operation, i.e., under light load or heavy load. With respect to the total amount of air in the head combustion chamber, air is introduced at a ratio of 8% to 20% through the air holes 28 formed in the end wall 21 at the head portion, air is introduced at a rate of 10% to 23% through the air holes 19*a* of the first row, and at a rate of 57% to 82% with respect to the amount of air for combustion in the head combustion chamber through the holes (19*b* to 19*d*) of the second to fourth row formed downstream.

The intensity of the vortex flow formed in the combustion chamber 11 at the head portion is governed by the relation between the amount of air introduced through the air holes 28 formed in the end wall 21 and the amount of air introduced through the air holes 19*a*. Therefore, when the values are smaller than the above-mentioned values, the stability of the flame decreases with the decrease in the intensity of vortex flow. Furthermore the stoicheometric mixing ratio ($\pi=1.0$) shifts in the direction of excess fuel ratio under light load, and the ratio falls outside the combustible range under heavy load, making it difficult to maintain good combustion. When the upper-limit values are exceeded, the stoicheometric mixing ratio ($\pi=1.0$) is approached under heavy load without creating any serious problem. Under the light load, however, relatively lean combustion takes place, and the flame is unstable. Therefore, combustion should be sustained by distributing the amount of air as described above.

Described below is means for supplying fuel that plays a very important role in constituting the combustor of the invention. First, if the above-mentioned embodiment is referred to, short fuel nozzles 22 (22*b*) for stabilizing the flame protrude up in the vicinity of the air holes 19*a* for first stage combustion. The fuel nozzle 22 (22*a*) for combustion have a length 1.5 times the position of the air holes 19*a*. The fuel nozzles 22*b* for stabilizing the combustion and the fuel nozzles 22*a* for combustion are alternatingly arranged annularly maintaining a pitch which is nearly equal to the protruding length of the fuel nozzle 22*b* for stabilizing the fuel. The fuel nozzles 22 (22*a*, 22*b*) inject the fuel in a direction nearly perpendicularly to the longitudinal axis of the combustion chamber. In this combustion system, the flame of flame-stabilizing portion and the flame for combustion take place being separated axially and annularly in the combustion chamber. Therefore, since the flames are dispersed, combustion is sustained over a low uniform temperature range so as to form relatively little NOx. In order to effectively establish combustion, distance between fuel nozzles may be shortened both in axial and annular directions to provide more fuel nozzles. This, however, is limited by the size and shape of the combustor. Further, high-temperature regions are formed by the mutual interference of the flames. If the number of fuel nozzles is reduced, the fuel is not well distributed, and it becomes difficult to limit the formation of NOx. As described by way of an embodiment of the present invention, therefore, it is essential to provide three to four air hole rows, for example, 19*a* to 19*d* in the axial direction to separately introduce the air into the head combustion chamber 11 arrangement of the fuel nozzles 22 annular direction keeps a distance such that the flames will not interfere with each other.

FIG. 13 illustrates another embodiment of the construction of a fuel nozzle. The nozzle 22*c* has fuel injection holes 22*d* and 22*e* for stabilizing the flame and for combustion.

FIGS. 14*a* and 14*b* illustrate a further embodiment of a fuel nozzle. The fuel nozzles 22*f*, 22*g* and 22*h*, 22*i* protrude from the side of the inner cylinder 11 and from the side of the cone 13, respectively.

The relationship between the length of the head combustion chamber and the fuel supply position of the second stage produces a function as described below inclusive of the cone 13 located in the head combustion chamber 11. That is, in the annular space 25 in the head combustion chamber 11, it is essential that the first stage fuel is nearly completely combusted. Even when the second stage fuel and air are supplied and combusted, flow in the head combustion chamber 11 of the first stage should be held to a minimum. The head combustion chamber 11 should be so determined that the fuel of the first stage is mixed with the air introduced through the holes 19*a* to 19*d* and is burned almost completely in the annular space 25 defined by the inner wall of the head combustion chamber and the outer wall of the cone 13.

FIG. 16 shows the relationship between the positions of the fuel and air supply means in the second stage and the NOx concentration. As the length of the head combustion chamber 11 is reduced, the fuel and the air are introduced from the second stage before the combustion is completed in the head combustion chamber 11, whereby combustion in the head portion is interrupted by the air from the second stage, and portions A are quickly cooled. Therefore, uncombusted components such as carbon monoxide and hdyrocarbons are formed in large amounts, decreasing the efficiency of combustion. Furthermore, if the second stage combustion is established under the above-mentioned condition, combustion takes place simultaneously in the first stage and in the second stage. Therefore, hot spots of high temperatures are formed in the combustion initiating portion of the second stage, resulting in the formation of large amounts of NOx.

Further, increase in the length of the head combustion chamber 11 causes the cooling area of the wall of the head combustion chamber to increase and, hence, permits the cooling air to flow in increased amounts. As the amount of cooling air increases as mentioned above, cooling air is introduced between the flame of the first stage and the fuel gas of the second stage when the fuel gas is to be introduced from the second stage. This adversely affects ignition from the first stage to the fuel gas of the second stage. For this reason, the length of the head combustion chamber 11 is not increased by more than a predetermined value. According to experiments conducted under the conditions of a combustion pressure of up to 10 atm and an air of a temperature of up to 350° C., it was found that the length of the head combustion chamber 11 should typically be from about 1.2 to about 2.0 as great as the outer diameter of the head combustion chamber 11, and should ideally be about 1.5 times that of the outer diameter of the head combustion chamber 11, though it may vary depending upon the diameter and length of the cone 13. Length of the cone 13 determine the volume of the head combustion chamber 11. Fundamentally, however, with the cone 13 being longer than the head combustion chamber 11, combustion gas expands in the rear combustion chamber 12 when combustion of the second stage is initiated, and the pressure loss (resistance) increases at the outlet portion of the head combustion chamber 11 due to the acceleration of combustion gas. Therefore, less air is introduced in the head combustion chamber 11. Low-temperature combustion with a lean mixture is no longer sustained in the head combustion chamber 11, i.e., large amounts of NOx are formed, the gas temperature rises, and the rate of air flow decreases. Therefore, the temperature rises on the outer peripheral wall of the head combustion chamber 11, and the combustor becomes less reliable and its working life is shortened. Therefore, the inner cylindrical cone 13 should have such a length that limits the effect of gas acceleration loss caused by combustion in the second stage. For this purpose, the cone 13 should be shorter than the head combustion chamber 11, and should have a volume sufficient to withstand a sudden expansion of combustion gas even when the combustion gas is accelerated from the tip of the cone to the outlet of the head combustion chamber. According to experiments, the ideal length Lb of the cone 13 should satisfy the relation $Lb/L=0.7$ relative to the length L of the head combustion chamber 11. Space from the front end of the cone 13 to the rear end of the head combustion chamber should be so determined as to establish the above-mentioned dimensional relation. Here, if the ratio Lb/L is small or if the cone 13 is short, the flame of first stage combustion is formed on the portion of axis at the front end of the cone 13. Therefore, a high-temperature portion is formed in the portion of axis, and NOx is formed in large amounts. As the ratio Lb/L approaches 1, furthermore, NOx is generated in large amounts as described above, and the temperature rises in the wall of the head portion. Accordingly, the cone 13 should be shorter than the head combustion chamber 11.

Through the same combustion tests as those mentioned earlier, it was found that to reduce the formation of NOx, carbon monoxide, and hydrocarbons in the first and second stages, the area of air openings relative to the head combustion chamber should be 50 to 55% of the total opening areas, the area of air openings relative to the second stage should be 20 to 30%, the air flow areas open to the rear combustion chamber should be 20 to 30%, and the cooling areas open to the cone 13 should be 7 to 10%. In particular, if the cone 13 is provided with air openings for combustion in addition to the openings for introducing cooling air, combustion is promoted by the air stream, and hot spots are formed. Therefore, the cone 13 should be provided only with the holes for cooling air. If the area of air holes relative to the second stage becomes greater than 30%, ignition is adversely affected. When this ratio is smaller than 20%, it becomes difficult to effectively limit the formation of NOx. If the amount of air to the head combustion chamber 11 is greater than 60%, the mixture becomes so lean that carbon monoxide and hydrocarbons are formed in large amounts. If the amount of air is smaller than 40%, on the other hand, the temperature of the metals rises and NOx is formed in large amounts.

FIG. 17 shows enlargement of the fuel nozzles 34 and the whirling vanes 37. The whirling vanes 37 are disposed in parallel to each other and inclined to the axis of the inner cylinder 4 to whirl the air. The nozzles 34 have at the tips injection holes 34 perforated in the radial and peripheral directions with respect to the inner casing 4. The tip portion is disposed in the air hole 33 at the central portion with respect to the cross-section of the air hole so that fuel injected through the hole 35 is well mixed with air.

FIG. 18 illustrates a modification of the whirling vane 37. The vane 37 has a bent portion (41*a*, 41*b*, 41*c*) which is parallel to the axis of the nozzle 34.

FIG. 19 shows another embodiment of the fuel and air supply means according to the present invention. In this embodiment, the whirling vanes 37 are secured to both a supporting member 38 which is joined to the nozzle flange 39, and a guide plate 43*b*. The supporting member 38 and guide plate 43*b* are inserted between the head combustion and the rear combustion chamber 12 via resilient sealing members 42*a* and 42*b* so that the whirling vane 37 will be free from displacement of the inner cylinder 4 due to the thermal expansion. The nozzle 34 secured to the nozzle flange 39, axially extends into the air hole defined by the vanes 37. Air for second stage combustion is introduced into the rear combustion chamber 12 through a guide portion formed by a guide member 43*a* supported by the suporting member 38 and a guide portion 43*b* of the guide plate, whereby the air is introduced smooth into the combustion chamber without producing eddy and without staying.

Combustion of the second stage will be described below with reference to FIGS. 17 to 19. The fuel 17 is introdced into a fuel reservoir 31 via a path 30 as shown in FIG. 19. The fuel nozzles 34 supply the fuel to the vicinity of air inlets or holes 33 that are open in the air path 32 of the second stage and in the rear combustion chamber 12. That is, the fuel of the second stage is supplied from the fuel reservoir 31 and is injected through fuel injection holes 35 along with the air stream through the air holes 33. The air stream 36 of the second stage is supplied into the main combustion chamber in the form of a whirling stream 36' (shown in FIG. 5) so that combustion time is extended as long as possible. The lean mixture is then supplied into the main combustion chamber where the gas is ignited by the flame of the head combustion chamber, and low-temperature lean combustion is established to decrease the formation of NOx. The key point to reduce the formation of NOx in the second stage is how to thoroughly mix air and fuel. The best method for this purpose is to extend the mixing time. In the present invention, the whirling vanes 37 are provided to lengthen the air paths, and the fuel is supplied into the whirling streams flowing therethrough.

With regard to the combustion taking place in the second stage, furthermore, the important point is that the flame not be introduced into the air paths of the second stage and, particularly, that the flame not be introduced into the vanes 37. The air paths surrounded by the vanes 37 establish conditions that insure adequate combustion. However, the ejecting speed of a mixture of the air and fuel through the vanes 37 is about 100 meters/second, whereas, the propagation speeed of flame in a turbulent flow is 5 meters/second at the fastest. Under ideal conditions, therefore, backfire does not occur. Depending upon the shape of vanes and finishing degree of the surfaces thereof, however, eddy of the mixture may develop near the wall surfaces of vanes, and the flame may be drawn into the vanes with eddy as the eddy is ignited, thereby causing backfire. To cope with this problem, the fuel 17 is injected from the injection holes 35 into the air paths surrounded by the whirling vanes 37. For this purpose, the injection holes are between the whirling vanes. Furthermore, it is preferable that the upstream side of the whirling vanes 37 is curved as designated at 41*a*, 41*b*, 41*c*, as shown in FIG. 18, so as to be in alignment with the axis of the fuel nozzles 34, such that the fuel and the air are mixed together more desirably. No eddy or stagnation develops near the surfaces of the whirling vanes 37, and no backfire takes place. The injection holes 35 of fuel nozzles 34 positioned at the centers of air paths surrounded by the whirling vanes 37, facilitate homogeneous mixing the air and the fuel. Here, it is also important that homogeneous mixing is not lost. The deviation in position between the whirling vanes 37 and the fuel nozzles 35 which is caused by the difference in the thermal expansion between the inner cylinder 4 and the outer cylinder 5 that supports the fuel nozzles 35 of the second stage loses homogeneous mixing. The structure of FIG. 19 prevents the deviation.

The structure shown in FIG. 19 maintains a homogeneous mixture of the air and fuel for long of time. Further, concentration of fuel is not diverted in the air path, and local hot spots are not formed. Moreover, smooth flow of air by the curved portions 43*a*, 43*b* effects homogeneous mixing of the air and fuel. No eddy current or stagnation develops, nor any backfire.

Described below is the formation of NOx that is affected by the interference of flame in the first and flame in the second stage and the air stream are introduced nearly at right angles (or it may be a swirling current) with the flame 45 of head portion from the rear portion 44 of the head combustion chamber, the flame 45 of head portion interferes as designated at 47 with the rear flame 46, thereby causing hot spots where the combustion temperature is high forming NOx in large amounts. As shown in FIG. 21 therefore, it is essential to divide the flame so that the flame 45 of head portion is not interfere with the flame 46 of rear portion, and that NOx is formed only in small amounts. Therefore, it can be contrived to direct the flame of the second stage toward a direction indicated by a dotted line 48. In this case, however, the fuel injected into the second stage is not ignited so quickly by the flame 45 of head portion. Therefore, the flame in the second stage cannot be outwardly directed excessively.

FIG. 22 shows in comparison the NOx concentrations, by ratio (NOx ②/NOx ①) of NOx in second stage to NOx in first stage, when the flame is directed in a horizontal direction as indicated by a curve A and when the flame is directed at right angles thereto as indicated by a curve B. Interference with the flame is reduced, and NOx is formed in reduced amounts when the flame is introduced in a horizontal direction rather than in a direction at right angles thereto.

As described above, a plurality of fuel nozzles are provided in the first stage and in the second stage, and the fuel is supplied from the outer circumferential portion of the combustor liners, in order to disperse the fuel and to homogeneously mix the air and fuel together. Therefore, combustion is effectively sustained under low-temperature and excess-air conditions, making it possible to greatly limit the formation of NOx. That is, as shown in FIG. 23, formation of NOx can be greatly limited in the first stage. Furthermore, with the second stage being combined as indicated by a line B, much less NOx is formed compared with the conventional combustors indicated by a line A.

FIG. 24 illustrates how the combustion condition in the first stage affects the combustion condition in the second stage. Namely, FIG. 24 shows the distribution of gas temperature at the outlet portion of the head combustion chamber. According to the conventional combustors in which a single fuel nozzle is located on the axis, the temperature rises at the axis in the combustion chamber. According to the present invention, however, the fuel is well distributed, and the air and the fuel are homogeneously mixed. Therefore, the high-temperature portion that was seen in the prior art is not present. As a matter of course, therefore, high-temperature portion that was seen in the prior art is not present therefore, high-temperature portions are likely to exist along the periphery. According to the present invention, furthermore, the cone 13 is installed in the portion of axis, and cooling air is supplied. Therefore, no high-temperature portion develops along the axis. Namely, Nox is formed in greatly reduced amounts by first stage combustion.

According to the present invention, furthermore, the temperature rises along the periphery greatly facilitating combustion in the second stage. That is, the combustion in the second stage is carried out with a lean mixture at temperature. The temperature rise along the periphery facilitates combustion, making it possible to reduce the formation of uncombusted components such as carbon monoxide (CO), uncombusted products (HC) and the like.

FIG. 15 shows the results of combustion tests using the combustor of the construction of the present invention. Compared with a conventional combustion system of a multiburner using an air-whirling flame stabilizer in an annular combustion chamber, the combustion system of the present invention helps reduce the formation of NOx by 30% during the rated operation of a gas turbine. With regard to the flame stability, furthermore, it was confirmed that the combustion could be stably sustained over the operating range of the gas turbine.

What is claimed is:

1. A gas turbine combustor comprising:

a head combustion chamber disposed along a longitudinal axis for effecting ignition and maintaining flame;

a rear combustion chamber communicating with a downstream side of said head combustion chamber for admitting and combusting premixed fuel and air therein;

a tubular hollow member at an upstream side of said head combustion chamber along the longitudinal axis to define an annular combustion space;

means for producing diffusion combustion around said tubular member during operation of said combustor and vortex mixing between fuel and air, said means consisting of air inlet means at an upstream side of said annular combustion space for introducing air into said annular combustion space and a plurality of first nozzles projecting into said annular combustion space a distance sufficient, on one hand, to inject fuel into said annular combustion space to produce the diffusion combustion and, on the other hand, to produce the vortex mixing upstream of a fuel injection part of one or more of said nozzles;

a plurality of premixing spaces for admitting fuel and air, said premixing spaces being disposed around the periphery of and at the upstream side of said rear combustion chamber so as to communicate with said rear combustion chamber; and a plurality of second nozzles for injecting fuel into said premixing spaces.

2. A gas turbine combustor according to claim 1, wherein said combustor comprises an axially elongated inner casing defining said head combustion chamber and having an end wall on the upstream side, said end wall having a plurality of air holes annularly arranged therein for introducing combustion air into said annular combustion space; an outer casing disposed around and spaced from said inner casing to form an annular air passage therebetween; and an end cover provided at an end of said outer casing at an axial distance from said end wall to provide an air passage communicating with said annular air passage.

3. A gas combustion chamber according to claim 1, wherein said plurality of first nozzles comprise fuel injection nozzles in which alternate nozzles are of different length in the direction of the longitudinal axis so as to inject fuel at axially different positions.

4. A gas turbine combustor according to claim 1, wherein said tubular hollow member is coaxially with a central axis of said head combustion chamber and projects axially therein from an upstream side end of said head combustion chamber in a downstream direction, said tubular hollow member having a conical surface defining in cooperation with an inner casing of said head combustion chamber said annular combustion space increasing in cross-sectional area from the upstream side toward the downstream side, and said tubular hollow member having a plurality of fine cooling air holes on the conical surface and an end wall on the downstream side.

5. A gas turbine combustor according to claim 4, wherein said combustor comprises an axially elongated inner casing defining said head combustion chamber and having an end wall on the upstream side, said end wall having a plurality of air holes annularly arranged therein for introducing combustion air into said annular combustion space; an outer casing disposed around and spaced from said inner casing to form an annular air passage therebetween; and an end cover provided at an end of said outer casing at an axial distance from said end wall to provide an air passage communicating with said annular air passage.

6. A gas turbine combustor according to claim 5, wherein said first nozzles are secured to said end cover and project into said annular combustion space through said air holes with gaps formed therebetween for air passage, each of said first nozzles having a tip portion with a fuel injection hole, and said inner casing having air holes formed in axially spaced rows around the periphery thereof and in relation to each said fuel injection hole so as to produce a weak vortex flow upstream of said first nozzles such that the vortex flow includes flow components directed radially from said first nozzles and reverse flow from said first nozzles toward said end wall.

7. A gas turbine combustor according to claim 6, wherein each said fuel injection hole opens substantially perpendicular to the longitudinal axis.

8. A gas turbine combustor according to claim 6, wherein one of said rows of air holes most proximate to said end wall has a location (La) within a range of:

$$La=(0.6-1.7)\times Lc,$$

where Lc is a radial length corresponding to a difference in radius between said inner casing and said tubular member at said end wall, and said tubular member has a length (Lb) extending downstream from said end wall within a range of:

$$Lb=(2.0-5.20)\times Lf,$$

where Lf is a position of said fuel injection holes most axially distant from said end wall.

9. A gas turbine combustor according to claim 6, wherein the air holes in said end wall are dimensioned so as to permit introduction of air in amounts of 8% to 20% into said head combustion chamber, the air holes of said one of said rows of air holes most proximate to said end wall are dimensioned so as to permit air in amounts of 10% to 23% into said head combustion chamber, and the air holes in remaining rows of said rows of air holes are dimensioned so as to permit air in amounts of 57% to 82% into said head combustion chamber.

10. A gas turbine combustor comprising:

a generally cylindrical head combustion chamber having a longitudinal axis for effecting therein first stage combustion over a wide load range to produce a gas stream;

a rear combustion chamber operatively arranged downstream of said head combustion chamber for effecting therein second stage combustion over the wide load range;

a plurality of nozzles arranged in said head combustion chamber for injecting fuel therein in at least one position downstream from a wall at an upstream end of said head combustion chamber;

air inlet means arranged in said upstream end wall and in rows around a peripheral portion of said head combustion chamber so as to produce a weak vortex flow upstream of at least some of said nozzles such that the vortex flow includes flow components directed radially from said at least some of said nozzles and reverse flow from said nozzles toward said upstream end wall; and a plurality of fuel and air supply means annularly arranged at an upstream peripheral wall of said rear combustion chamber for introducing pre-mixed fuel while swirling around the gas stream of said first stage combustion with minimal interference therebetween, wherein the nozzles are arranged annularly through said upstream end wall, and alternate nozzles are of different length in the direction of the head combustion chamber longitudinal axis such that one set of nozzles injects fuel downstream of a first row of said air inlet means and a second set of nozzles injects fuel upstream of the first row of said air inlet means.

11. A gas turbine combustor according to claim 10, wherein means is provided for supplying through the air inlet means arranged in said upstream end wall 8% to 20% of the total air supplied to said head combustion chamber, for supplying through a first row of air inlet means located at most upstream position of the rows of air inlet means 10% to 23% of the total air supplied to said head combustion chamber, and for supplying through remaining rows of the air inlet means 57% to 82% of the total air supplied to said head combustion chamber.

12. A gas turbine combustor, comprising:

an axially elongated inner casing having an upstream side and a downstream side, and end wall provided on the upstream side, said end wall including a plurality of air holes annularly arranged therein, means provided on the downstream side for exhausting a combustion gas to gas turbine blades, said inner casing defining a head combustion chamber on the upstream side and a rear combustion chamber on the downstream side and having a plurality of air holes formed in the peripheral wall defining said head combustion chamber;

an outer casing disposed with respect to the inner casing so as to form an annular air passage between said inner and outer casing, an end of said outer casing at a distance from said end wall thereby providing an air passage communicating with said annular air passage;

a hollow frusto-conical tubular member, coaxially disposed in said head combustion chamber of said inner casing so as to project into said head combustion chamber from said end wall, said tubular member having a conical surface defining an annular combustion space in cooperation with said inner casing, said annular combustion space increasing in cross-sectional area from the upstream side toward the downstream side, said tubular member having a plurality of fine cooling air holes on the surface in said head combustion chamber and a closed end on the downstream side;

a plurality of annularly arranged elongated fuel nozzles secured to said end cover so that said fuel nozzles project into said annular combustion space through said air holes of said end wall so as to form gaps for air passage between said air holes and said fuel nozzles, each of said fuel nozzles having a fuel injection hole at a tip portion thereof, said fuel injection holes being disposed in a vicinity of said air holes formed in said peripheral wall of said head combustion chamber on the upstream side to produce a weak vortex flow upstream of said fuel nozzles;

a plurality of air inlets annularly arranged on said inner casing for substantially axially introducing air into said rear combustion chamber; and second stage combustion fuel nozzles arranged annularly around said rear combustion chamber for injecting fuel into said air flows from said fuel inlets so as to provide pre-mixed air and fuel to said rear combustion chamber and configured so as to obtain an annular flame which surrounds and causes no substantial interference with the flame of said head combustion chamber wherein said air holes provided in the peripheral wall of said inner casing are arranged in a plurality of rows axially arranged at an interval therebetween, and an axial position La of said row of air holes on the most upstream side from said end wall is within the range of:

$$La=(0.6-1.7)\times Lc.$$

where Lc is radial length corresponding to a difference in radius between said inner casing and said tubular member at said end wall, and a length Lb of said tubular member from said end wall to the downstream end is within a range of:

$$Lb=(2.0-5.20)\times Lf,$$

wherein Lf is a position of said fuel injection holes most distant from said end wall.

13. A gas turbine combustor according to claim 12, wherein the air holes formed in said end wall are sized to introduce air in amounts of 8% to 20% into said head combustion chamber.

14. A gas turbine combustor according to claim 12, wherein said fuel nozzles in said head combustion chamber have dissimilar lengths to alter the position for injecting fuel into said head combustion chamber.

15. A gas turbine combustor according to claim 12, wherein said fuel nozzles projecting into said head combustion chamber are opened in a vicinity of said air hole row on the most upstream side so as to inject fuel thereat.

16. A gas turbine combustor comprising a head combustion chamber into which fuel and air for a first stage combustion are introduced for combustion therein, and a rear combustion chamber into which pre-mixed fuel and air for a second stage combustion are introduced downstream of said head combustion chamber so as to flow axially while whirling around a longitudinal axis of said combustor, comprising:

an inner tubular hollow member coaxial with an axis of said head combustion chamber to define an annular combustion space between said head combustion chamber and said tubular member, said tubular member having a front end on a downstream side of said head combustion chamber and a plurality of fine cooling air holes in a peripheral wall thereof;

a wall positioned at an upstream end of said head combustion chamber and having plurality of air holes formed therein for injecting air in said annular combustion space thereby to form a plurality of vortices, said wall defining an upstream end of said annular combustion space;

means for producing diffusion combustion around said tubular hollow member during operation of said combustor and vortex mixing between the fuel and air, said means consisting of an inlet means including said air holes and a plurality of fuel nozzles projecting into said annular combustion space a distance sufficient for supplying the fuel for the first stage and opening at a downstream portion of said air holes so that part of the fuel injected by said nozzles is subjected to said vortices for stabilizing the flame formed by first stage combustion in said head combustion chamber upstream of a fuel injection part of one or more of the nozzles, and the remaining part of the fuel produces the diffusion combustion at a downstream side of said vortices; and a plurality of second stage nozzles provided at a periphery of said rear combustion chamber with air inlet means for pre-mixing of fuel and air and located downstream from the front end of said inner tubular member for injecting premixed fuel and air into said rear combustion chamber.

17. A gas turbine combustor according to claim 16, wherein said head combustion chamber has a longitudinal axial length of between 1.2 and 1.8 times an outer diameter of said head combustion chamber.

18. A gas turbine combustor according to claim 16, wherein said plurality of fuel nozzles each opens perpendicularly to the axis of said head combustion chamber.

19. A gas turbine combustor according to claim 16, wherein said plurality of fuel nozzles open downstream of said vortices formed on said annular combustion space at a location which allows the vortices to catch part of the fuel injected by each of said fuel nozzles.

20. A gas turbine combustor according to claim 16, wherein said plurality of air holes formed in said wall each are defined by a cylindrical inner surface so that air passes through said air holes.

21. A gas turbine combustor according to claim 16, wherein each of said second stage fuel nozzles has a plurality of fuel injection holes at a tip portion thereof and whirling vanes are provided to form the air inlet means such that said fuel injection holes are inserted between the whirling vanes.

22. A gas turbine combustor according to claim 21, wherein the whirling vanes have openings in a direction in which air is ejected nearly parallel with a longitudinal axis of the combustor.

23. A gas turbine combustor according to claim 21, wherein the whirling vanes have portions parallel to an axis of each of said second stage fuel nozzles and portions inclined to said axis to form a whirling air stream substantially parallel to a longitudinal axis of the combustor.

24. A gas turbine combustor according to claim 21, wherein means is provided for supporting the whirling vanes free of influence caused by thermal expansion of said supporting means, and means are provided in operative relation to the whirling vanes for guiding air smoothly between the whirling means.

25. A gas turbine combustor comprising:

an outer casing;

an end cover mounted on one end of said outer casing on the upstream side for closing said one end of said outer casing;

an elongated inner casing having a small diameter portion defining a head combustion chamber on an upstream side and a large diameter portion greater than that of said small diameter portion and defining a rear combustion chamber on a downstream side, said inner casing being disposed in said outer casing so as to define therebetween an annular air passage communicating with an air compressor;

combustion air inlets provided on a periphery of said head combustion chamber and arranged in rows for introducing air from said annular passage into said head combustion chamber, said rows of combustion air inlets being spaced from each other and extending in a peripheral direction;

an end wall provided for closing one end of said inner casing on the upstream side and having a plurality of annularly arranged air holes;

a tubular member disposed in and coaxially with said head combustion chamber for defining an annular combustion space axially elongated and having a front end on the downstream side and a plurality of fine cooling air holes on a periphery thereof for introducing cooling-air from said annular air passage into said annular combustion space;

means for producing diffusion combustion around said tubular member during operation of said combustor and vortex mixinbg between fuel and air, said means consisting of air inlet means at an upstream side of said annular combustion space for introducing air thereinto and a plurality of fuel nozzles for injecting fuel projecting into said annular combustion space through said air holes of said end wall such that the fuel injection holes of the fuel injection nozzles are positioned at a most upstream side row of said combustion air inlets, each of said air holes and each of said fuel nozzles passing through said air holes defining an annular air space for allowing air from said annular air passage to enter said head combustion chamber, said air inlet means including said annular air passage and at least one of said combustion air inlet rows, whereby said means, on one hand, injects fuel into said annular combustion space to produce the diffusion combustion, and on the other hand, produce the vortex mixing upstream of a fuel injection part of one or more of said nozzles;

a plurality of air inlets having swirling vanes and disposed at a periphery of said rear combustion chamber on the upstream side of said rear combustion chamber so as to allow a flow of air in an axial direction of said rear cqmbustion chamber while swirling the air along the periphery thereof; and a plurality of fuel nozzles for injecting fuel into said air inlets so that the fuel is mixed with air to produce a resultant fuel-air mixture flowing axially while swirling prior to introduction into the rear combustion chamber such that combustion of said mixture does not cause substantial interference with a combustion flame in said head combustion chamber.

* * * * *